US006387220B1

(12) United States Patent
Mohrsen et al.

(10) Patent No.: US 6,387,220 B1
(45) Date of Patent: May 14, 2002

(54) VACUUM CONVEYOR

(75) Inventors: Leif Mohrsen; Allan Broom; George Kutak-Petrik, all of New Westminster (CA); Wolfgang Drefs, Hüttlingen (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/625,307

(22) Filed: Jul. 25, 2000

Related U.S. Application Data

(63) Continuation-in-part of application No. 09/373,562, filed on Aug. 13, 1999, now abandoned.

(51) Int. Cl.[7] ..... D21F 1/48

(52) U.S. Cl. ..... 162/363; 162/289; 162/193; 162/306; 162/202; 162/207; 162/255; 162/272; 162/354; 162/264; 226/91; 226/95; 226/97

(58) Field of Search ..... 162/363, 289, 162/193, 306, 202, 207, 255, 272, 354, 264; 226/91, 95, 97

(56) References Cited

U.S. PATENT DOCUMENTS 3,470,064 A 9/1969 Schwerdt
4,022,366 A 5/1977 Rooney
4,692,215 A 9/1987 Kerttula
5,837,101 A 11/1998 Ilvespaact

FOREIGN PATENT DOCUMENTS

DE 2636887 3/1977

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Apparatus for transferring at least a portion of a running web from a first section of a web making machine to a second section of the web making machine includes at least two pulleys, in which at least one is a driven pulley, a suction box coupled to a vacuum source, an air-pervious endless conveyor belt tensioned over the at least two pulleys to form a conveying run and a return run, and a device for creating a negative pressure at an inner surface of the conveying run. The at least one driven pulley is adapted to drive the endless conveyor belt over the at least two pulleys while the negative pressure propagates through the conveying run. The endless conveyor belt includes an upstream and a downstream end and the endless conveyor belt is pivotable around a pivot axis located in a region of the upstream end. The endless conveyor belt is pivotable to move the portion of the running web between the rope section and the portion is adapted to receive a full width of the running web. Apparatus also includes a control system for moving the downstream end into an area of the web width when a beginning of the at least a portion of the web has entered the rope section.

19 Claims, 5 Drawing Sheets

Fig.4
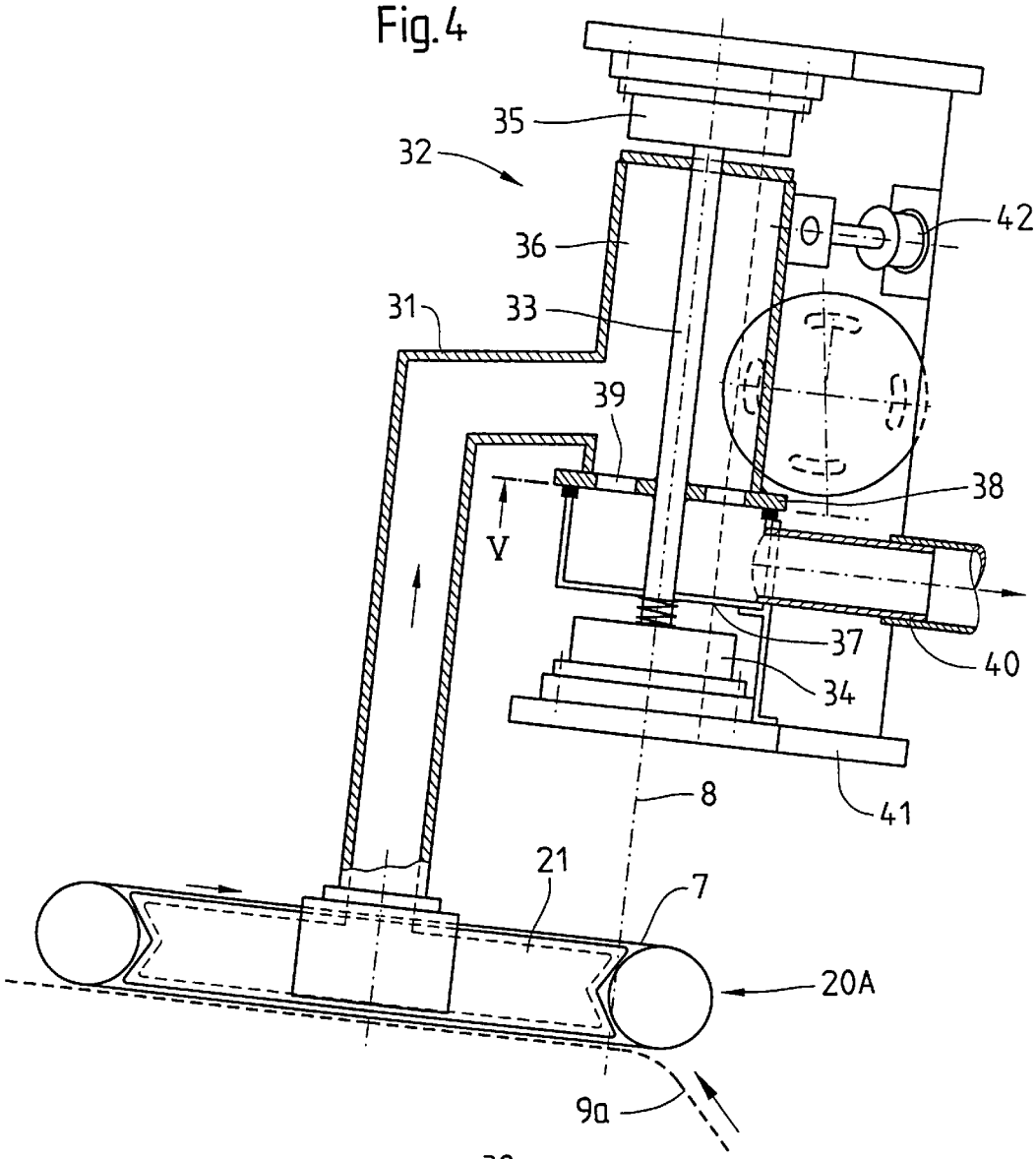
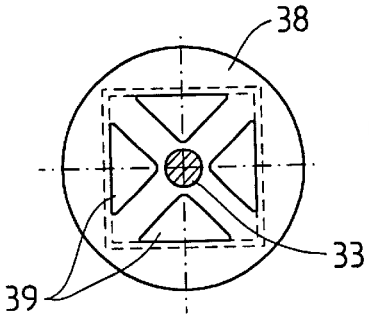
Fig.5

VACUUM CONVEYOR

CROSS-REFERENCE TO RELATED APPLICATIONS

The present application is a continuation-in-part of U.S. patent application Ser. No. 09/373,562 filed Aug. 13, 1999, now abandoned, the disclosure of which is expressly incorporated by reference herein in its entirety.

BACKGROUND OF THE INVENTION

1. Field of the Invention

This invention relates to an apparatus for transporting a web of a flexible material between a first and a second position. In particular, and in a preferred embodiment, the invention provides an apparatus, known as a "vacuum conveyor", for transporting a web, preferably a lead strip (or "tail") of a paper web, e.g. from the dryer of a paper-making machine to the first nip of a calender of the machine or to a winding machine or between any other sections of a paper-making or paper-finishing (e.g. coating) machine.

2. Discussion of Background Information

A vacuum conveyor is known from DE 26 36 887 which is similar to U.S. Pat. No. 4,022,366. Conveyors of this kind have proven successful in operation. In some applications, however, the lead strip must be deviated (in a known manner) out of the area of the web width into the area of a rope system which is outside the web width, for threading the lead strip through the following machine-section. For this purpose, the conveyor is arranged in an oblique position so that its downstream end is positioned in the area of the rope system outside the web width. A problem is that immediately after the transfer of the beginning of the lead strip into the rope system, the following main part of the lead strip shall travel again in its area inside the web width. Therefore, only the beginning of the lead strip must positively cling to the conveyor's belt. Immediately thereafter the lead strip should have only a loose contact to the conveyor. For that purpose one tries to rapidly decrease the degree of vacuum applied to the conveyor. But that does not always work in a reliable manner, in particle with the high operating speed of modern paper machines.

U.S. Pat. No. 4,692,215 discloses a vacuum conveyor cooperating with a rope system which again is positioned outside the web width. The vacuum conveyor is adjustable around a vertical axis which is arranged at the upstream pulley of the conveyor, so that the tail can be directed into the rope nip.

However, this document does not disclose any details how to control the adjustment or movement of the conveyor around the vertical axis. Such a control should be very precise because the transfer of the beginning of the tail into the rope nip must go on with the normal machine speed (up to about 2000 m/min), i.e., within a period of about 1 second or less. Moreover, U.S. Pat. No. 4,692,215 does not disclose any details how to support the vacuum conveyor with respect to the axis.

Therefore, the invention is based an the problem of further developing the known vacuum conveyor in such a way that the transfer of a lead strip into a following machine section is improved, in particular at high operating speeds.

SUMMARY OF THE INVENTION

According to a first aspect of the invention, the belt conveyor can be pivoted —immediately after it has transferred the beginning of a leading strip into a rope system from an oblique position into a straight, forward position, whereby it moves the lead strip into the area of the web width, so that, the conveyor now reliably transfers the main part of the lead strip—within the area of the web width—into the following machine section. In summary, the transfer of the lead strip from the preceding to the following machine section will be significantly improved, even at high operating speeds.

According to a second aspect of the invention, a vacuum conveyor is supported by a connecting structure which connects the conveyor with a rotatable support. The rotatable support includes a rotatable bearing housing which is fixed to the connecting structure, with at least one bearing being arranged within the bearing housing and being supported by a stationary central stub or by a stationary central section of the vacuum line. This design is very compact and very easy to integrate into any type of paper machine. This is due to the fact that the rotatable support includes a base plate, e.g., only one, for connecting the rotatable support to a machine frame. It is therefore a universal pivot which is applicable not only with the vacuum conveyor designed according to the first aspect, but also with various other vacuum conveyors. The pivot axis may be arranged, e.g., vertical but outside the web width in order to remove the conveyor out of the machine. In a different embodiment, the pivot axis may be arranged parallel to the pulley's axes in order to vary the working direction of the conveyor.

According to a third aspect of the invention, the vacuum conveyor is again connected to a rotatable support. The connecting structure is now formed as a vacuum channel. Therefore, it has two functions, namely to support the vacuum conveyor as well as to connect it to the vacuum source. This novel design is space-saving and the manufacturing costs are low.

The present invention is directed to an apparatus transferring at least a portion of a running web from a first section of a web making machine to a second section of the web making machine arranged downstream from the first section, relative to a web run direction, the second section including a portion adapted to receive a full width of the running web and a rope section located outside of the full width receiving portion. The apparatus includes a belt conveyor which includes at least two pulleys, in which at least one is a driven pulley, an air-pervious endless conveyor belt tensioned over the at least two pulleys to form a conveying run and a return run, and a device for creating a negative pressure at an inner surface of the conveying run. The at least one driven pulley being adapted to drive the endless conveyor belt over the at least two pulleys while the negative pressure propagates through the conveying run. The belt conveyor also includes an upstream and a downstream end and the belt conveyor is pivotable around a pivot axis located in a region of the upstream end. The apparatus is pivotable to move the portion of the running web between the rope section and the portion is adapted to receive a fall width of the running web. The apparatus also includes a control system for moving the downstream end into an area of the web width when a beginning of the at least a portion of the web has entered the rope section.

According to a feature of the instant invention, a rotatable support, which is rotatable around the pivot axis and a connecting structure, may be adapted to support the apparatus. The connecting structure can couple the conveyor apparatus to the support. The rotatable support may be connected to a stationary structure by a motor for pivoting the apparatus. Further, the rotatable support can include a rotatable bearing housing which is fixed to the connecting structure, and at least one bearing may be arranged within the bearing housing and is supported by a stationary central stub.

In accordance with another feature of the present invention, the at least a portion of the running web includes a threading tail, and the running web includes a paper web.

According to still another feature of the invention, the pivot axis can be at least approximately vertical to a plane of a belt run direction.

The invention is also directed to an apparatus for transferring at least a portion of a running web including a belt conveyor that includes at least two pulleys, in which at least one is a driven pulley, an air-pervious endless conveyor belt tensioned over the at least two pulleys to form a loop, and a device for creating a negative pressure within the loop. The negative pressure is sufficient to draw the at least a portion of the running web onto the endless conveyor belt. The at least one driven pulley is adapted to drive the endless conveyor belt over the at least two pulleys, such that the negative pressure propagates through the conveyor belt. The apparatus also includes a connecting structure and a rotatable support which rotates around a pivot axis are provided, and the connecting structure couples the belt conveyor to rotatable support. The rotatable support includes a rotatable bearing housing fixed to the connecting structure, a stationary central stub, and at least one bearing, and the at least one bearing is arranged within the bearing housing, which is supported by one of the stationary central stub and a stationary central section of a vacuum channel.

According to a feature of the invention, at least one bearing can include a pair of tapered antifriction bearings, the bearing housing can be coupled to the stationary central stub by the pair of tapered antifriction bearings, and the rotatable bearing housing can be fixed in both axial directions relative to the stub. Further, at least one sealing device can arranged between the housing and the stationary central stub. An interior of the bearing housing may be completely closed to an outside atmosphere.

In accordance with another feature of the present invention, the at least a portion of the running web comprises a threading tail, and the running web comprises a paper web.

According to a further feature of the instant invention, the pivot axis can be about parallel to an axis of the first and second pulleys.

In accordance with still another feature of the invention, the rotatable support can be connected to a stationary structure by a motor for pivoting the endless conveyor.

The present invention is also directed to an apparatus for transferring at least a portion of a running web including a belt conveyor that includes at least two pulleys, in which at least one is a driven pulley, a suction box coupled to a vacuum source, and an air-pervious endless conveyor belt tensioned over the at least two pulleys. The suction box is located within a loop of conveyor belt and is positioned to create a vacuum sufficient to draw the at least a portion of the running web onto the endless conveyor belt. The at least one driven pulley is adapted to drive the endless conveyor belt over the at least two pulleys and over the suction box. The apparatus also includes a rotatable support that is rotatable around a pivot axis, and a connecting structure is adapted to couple the belt conveyor with the rotatable support. The connecting structure includes a vacuum channel that couples the suction box to the vacuum source.

In accordance with a feature of the present invention, the apparatus can further include a stationary structure, a stationary vacuum chamber, and the rotatable support can include a rotatable bar having at least one end. The at least one end of the rotatable bar can be supported in a bearing coupled to the stationary structure, and positioned to extend through the vacuum chamber. The vacuum chamber can be fixedly coupled to the connecting structure and to the rotatable bar, such that the vacuum chamber is rotatable. The rotatable bar may be positioned to extend through the stationary vacuum chamber which is open to an interior of the rotatable vacuum chamber, and the stationary vacuum chamber can be coupled to the vacuum source. Further, the pivot axis can be at least approximately vertical to a plane of a belt run direction.

The present invention is also directed to a process for transferring at least a portion of a running web from a first section of a web making machine to a second section of the web making machine arranged downstream from the first section, relative to a web run direction, the second section including a portion adapted to receive a full width of the running web and a rope section located outside of the fall width receiving portion with a belt conveyor. The belt conveyor includes at least two pulleys, in which at least one is a driven pulley, a device for creating a negative pressure, an air-pervious endless conveyor belt tensioned over the at least two pulleys, and the device for creating the negative pressure creating the negative pressure within a loop of the belt conveyor. The belt conveyor includes an upstream and a downstream end and the belt conveyor is pivotable around a pivot axis located in a region of the upstream end. The process includes rotating the endless conveyor belt by driving the at least one driven pulley, creating a negative pressure at an inner surface of the endless conveyor belt as the endless conveyor belt is traveling over the pulleys, and guiding the at least a portion of the running web onto the endless conveyor belt. In this way, the at least a portion of the running web is suctioned onto the endless conveyor belt. The process also includes transferring the at least a portion of the running web from the endless conveyor to the rope section located outside of a web width, pivoting the endless conveyor belt around the pivot axis to move the downstream end into an area of the rope section one of at and before the transferring, and pivoting the apparatus including the endless conveyor belt around the pivot axis to move the downstream end into an area of the at least a portion of the running web and inside the web width.

According to a feature of the instant invention, the pivoting to move the downstream end into an area inside the web width may begin at a selectable time after the beginning of the transferring.

In accordance with another feature of the present invention, the pivoting to move the downstream end into an area inside the web width may begin when a beginning of the at least a portion of the tail arrives at a selectable point located in a downstream section. The downstream section can be a calender. Further, a detecting device can detect the beginning of the at least a portion of the tail arriving at the selectable point.

According to yet another feature of the invention, the process can further include pivoting the endless conveyor belt around the pivot axis to position the downstream end adjacent the portion adapted to receive the full width of the running web.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 4 shows another design of a rotatable support;

FIG. 5 is a cross section along line V of FIG. 4;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
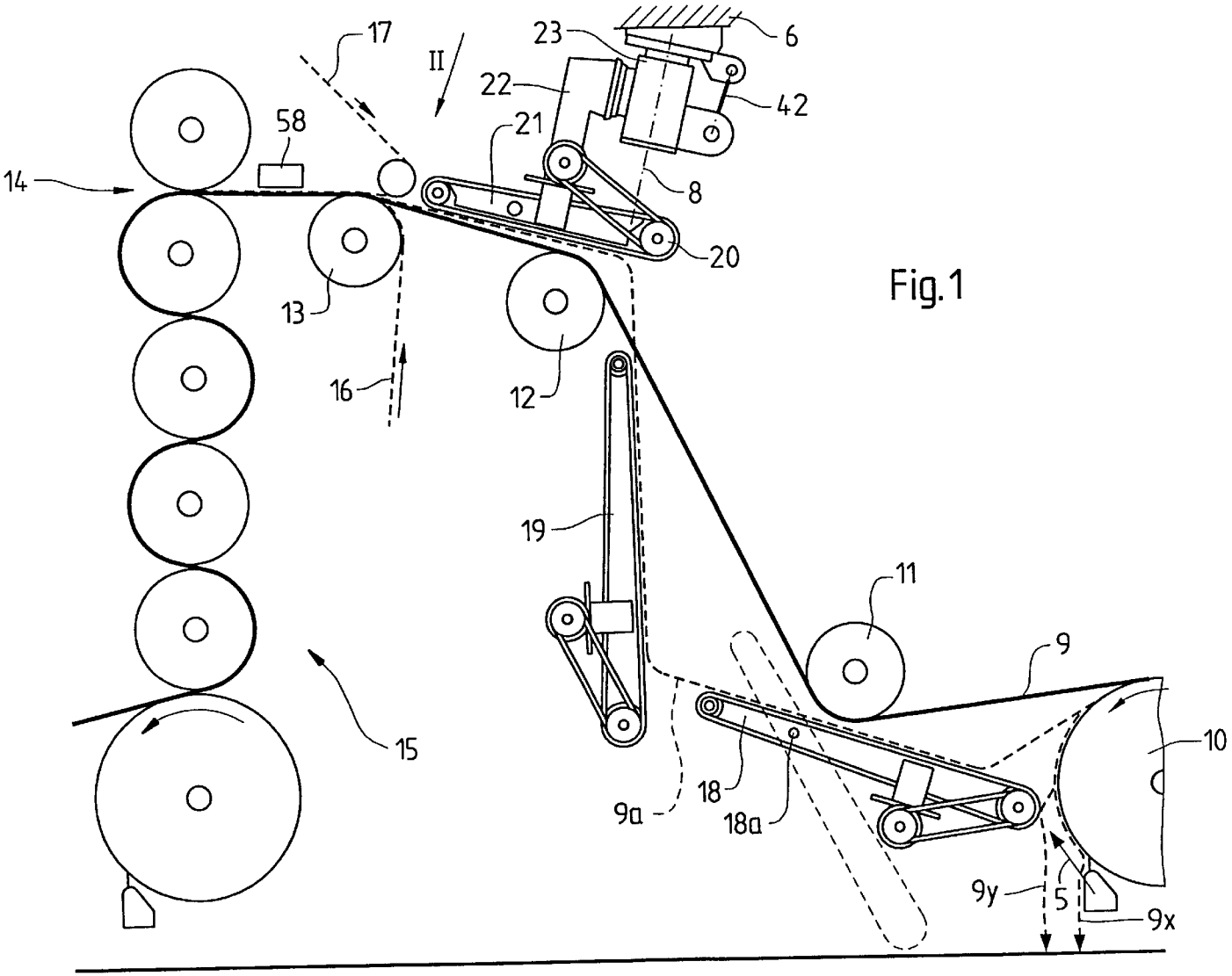
FIG. 1 shows schematically two sections of a paper-making machine, with some vacuum conveyors being disposed therebetween.
Figure 2:
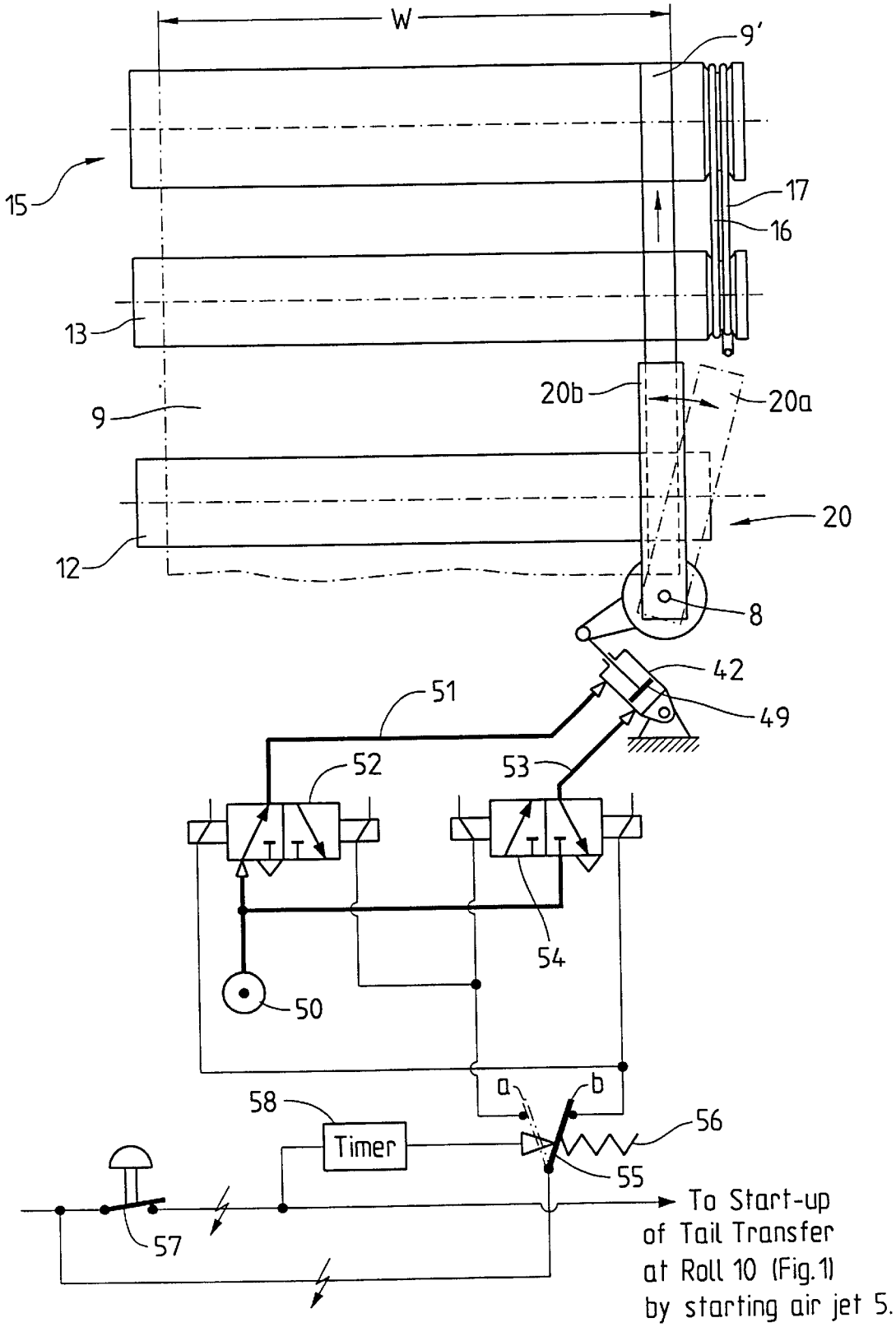
FIG. 2 is a view in direction of arrow II of FIG. 1.

According to FIG. 1, during normal operation, a paper web 9 is traveling through the final sections of a paper-making machine. The web leaves the last roll 10 or cylinder of a preceding section and is guided by paper rolls 11, 12 and 13 to the first roll nip 14 of a calendar 15. At the paper roll 13, which is positioned close to roll nip 14, two ropes 16 and 17 form a rope nip in a manner known in the art. This rope nip is arranged outside the width W of the paper web, as shown in FIG. 2.

During start-up of the machine or after an interruption of the paper-making process, paper web 9 initially travels downwardly from roll or cylinder 10 (along path 9*x*) into a broke pit (not shown). Then, paper web 9 must be threaded from section to section of the machine and through each of the sections, e.g. through a calender 15. For that purpose, at first a narrow edge strip or lead strip 9' (separated from the web by a cutting device) is transferred by vacuum belt conveyors 18 and 19 to a further belt conveyor 20 along a path 9*a* (illustrated by a dotted line). The transfer of lead strip 9' is started by an air jet 5 which changes the path of lead strip 9' (as shown at 9*y*) up to belt conveyor 18. Belt conveyor 20 is supported by a rotatable support 23 and has a pivot axis 8 being approximately vertical to the plane of the forwardly traveling belt run and being arranged close to the upstream end of conveyor 20. When the beginning of the lead strip 9 arrives at conveyor 20 the conveyor is in an oblique position 20*a* (FIG. 2). So conveyor 20 easily transfers the lead strip into the rope nip at roll 13. Thereafter the ropes 16, 17 transfer the lead strip through the calender 15 while conveyor 20 is re-turned around pivot axis 8 into the straight forward position 20*b*. Thereby, conveyor 20 moves the lead strip 9' into the area of the web width W and into the roll nips of the calender 15. Then, in a known manner, the lead strip is widened up to the full width of the web.

A pneumatic cylinder 42 with piston 49 is arranged to move conveyor 20 around axis 8. Pressure from pressure source 50 may be conducted either by line 51 and valve 52 to the one side of piston 49 or by line 53 and valve 54 to the other side of piston 49. Valves 52/54 are electrically controlled by switch 55, which is normally held in position a (e.g., by a spring 56). Then, line 53 is pressurized to hold conveyor 20 in position 20*a*.

The tail transfer may be started by closing a switch 57 starting the airjet 5 at roll 10 (FIG. 1). Via timer 58, switch 55 is changed-over to position b at a selectable time after closing of switch 57, causing to pressurize line 51 and moving conveyor 20 to position 20*b*, as shown in FIG. 2.

In contrast to FIG. 2, the change-over of switch 55 from a to b may also be triggered by a detector 58 (FIG. 1), which detects that the beginning of tail 9' has arrived at a selectable point of calender 15.

Each of the vacuum conveyors 18, 19, 20 comprises an endless perforated belt traveling over two rolls or pulleys. Between these pulleys, there may be a suction box 21 connected to a vacuum source (not shown) or other device to create a negative pressure at the conveying run of the belt. One of the pulleys can be driven by a conventional motor.

Figure 3:
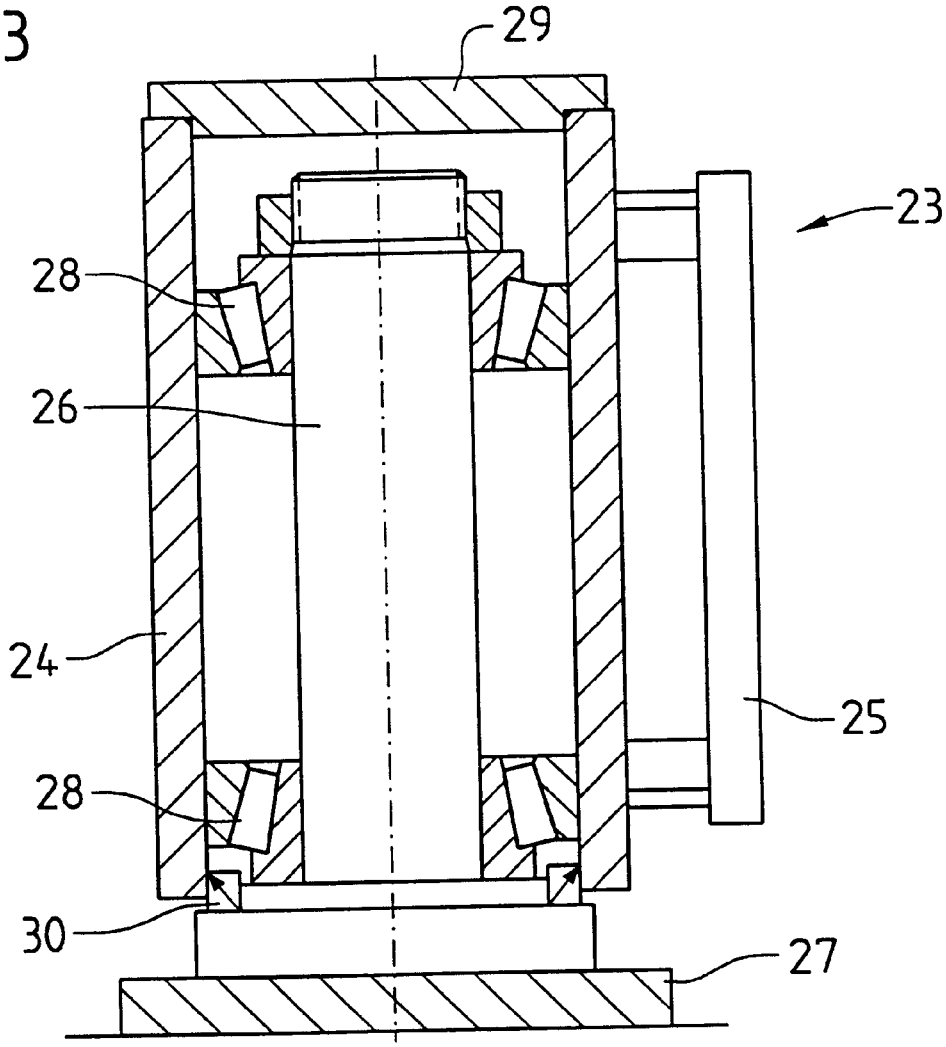
FIG. 3 shows a preferred design of s rotatable support of one of the vacuum conveyors of FIG. 1.

As shown in FIG. 1, conveyor 20 is supported by a connecting structure 22 which connects the conveyor 20 to a rotatable support 23, which is rotatable about pivot axis 8 and being connected to a machine frame 6 or any other suitable stationary structure. FIG. 3 shows details of the rotatable support 23 in a standing upright position, while in FIG. 1 support 23 is in an upside down position. A support 23 could also be used to carry the first conveyor 18 so that the latter is pivotable around a horizontal axis 18*a*.

According to FIG. 3, the rotatable support 23 comprises a rotatable bearing housing 24 to which a flange 25 is fixed. Any connecting structure (e.g., 22 of conveyor 20) may be mounted to flange 25. A stationary stub axle 26 being connected to a base plate 27 extends into the interior of housing 24. Stub axle 26 supports housing 24 by means of a pair of tapered antifriction bearings 23. Therefore, housing 24 is rotatable relative to stub 26 but fixed in both axial directions. The housing 24 is closed by a cap 29 and by a sealing device 30. Stub 26 is shown as to be solid, but it may also be hollow for providing a light-weight design or for providing a section of a vacuum channel, as shown in FIG. 6.

FIGS. 4 and 5 show another design of a connecting structure 31 and a rotatable support 32 of vacuum conveyor 20A. The connecting structure 31 is formed as part of a vacuum channel for connecting the suction box 21 to a vacuum source (not shown). In a preferred design, vacuum channel 31 is connected to suction box 21 (e.g., as disclosed in German Utility Model Application No. 299 10 850.3) in such a way that the air flows through the return run of the air-pervious endless belt 7. However, vacuum channel 31 may also be connected to a side wall of suction box 21, as shown in FIG. 7.

Rotatable support 32 comprises a rotatable bar 33 each end of which is supported in a bearing device 34, 35 which is connected by a stationary support 41 to a machine frame, not shown. Bar 33 extends through a rotatable vacuum chamber 36 and is fixed thereto. Chamber 36 is also fixed to the connecting structure 31 and is another part of said vacuum channel. Bar 33 also extends through a stationary vacuum chamber 37 which contacts an end wall 38 of chamber 36. End wall 38 has some openings 39. A stationary vacuum line 40 is connected to the stationary chamber 37 for connecting the rotatable support 32 to a vacuum source. The rotatable vacuum chamber 36 is connected to the stationary support 41 by any type of actuator 42 for moving the vacuum conveyor 20A around its pivot axis 8. A similar actuator 42 is provided in FIG. 1 for moving the vacuum conveyor 20.

Figures 6, 7:
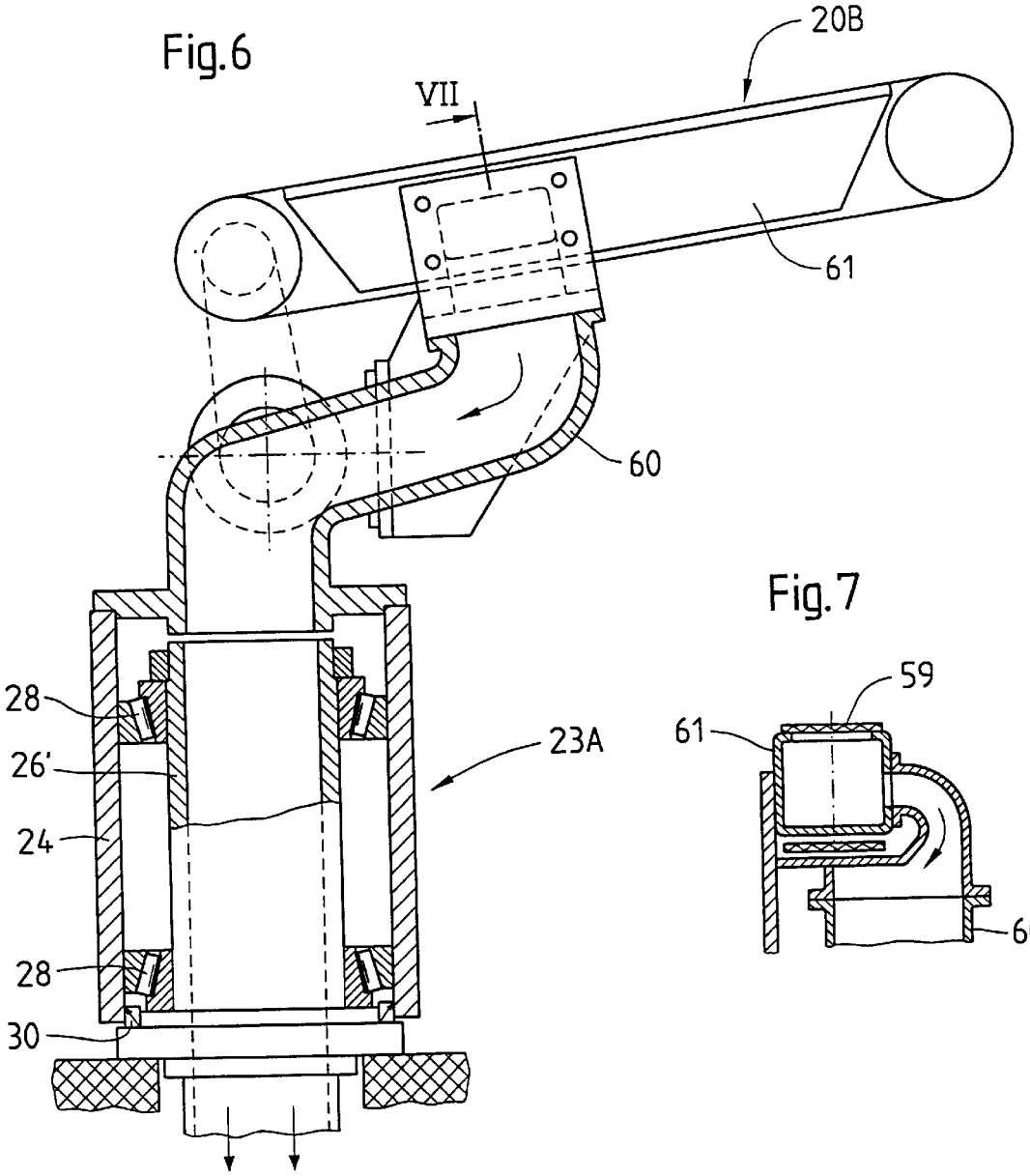
FIG. 6 shows another rotatable support of a vacuum conveyor.
FIG. 7 is a cross-section along line VII depicted in FIG. 6.

According to FIGS. 6 and 7, a vacuum conveyor 20B is supported by a vacuum channel 60, which, e.g., is connected to a side wall of suction box 61. The belt is designated as 59. Channel 60 is mechanically connected to rotatable housing 24 of support 23A, which is similar to support 23 of FIG. 3. Support 23 comprises a hollow stub 26' which connects the channel 60 to a further vacuum line 62 being connectable to a vacuum source (not shown).

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for transferring at least a portion of a running web from a first section of a web making machine to a second section of the web making machine arranged downstream from the first section, relative to a web run direction, the second section including a portion adapted to receive a full width of the running web and a rope section located outside of the full width receiving portion, said apparatus comprising:

at least two pulleys, in which at least one is a driven pulley;

an air-pervious endless conveyor belt tensioned over said at least two pulleys to form a conveying run and a return run;

a device for creating a negative pressure at an inner surface of said conveying run;

said at least one driven pulley being adapted to drive said endless conveyor belt over said at least two pulleys while the negative pressure propagates through said conveying run;

an upstream and a downstream end and said belt conveyor being pivotable around a pivot axis located in a region of said upstream end, wherein said belt conveyor is pivotable to move the portion of the running web between the rope section and the portion adapted to receive a fall width of the running web; and a control system for moving the downstream end into an area of the web width when a beginning of the at least a portion of the web has entered the rope section.

2. The apparatus in accordance with claim 1, further comprising a rotatable support which is rotatable around the pivot axis and a connecting structure adapted to support said belt conveyor, wherein said connecting structure couples said belt conveyor to said support.

3. The apparatus in accordance with claim 2, wherein said rotatable support is connected to a stationary structure by a motor for pivoting said conveyor.

4. The apparatus in accordance with claim 2, wherein said rotatable support comprises a rotatable bearing housing which is fixed to said connecting structure, and at least one bearing is arranged within said bearing housing and is supported by a stationary central stub.

5. The apparatus in accordance with claim 1, wherein said at least a portion of the running web comprises a threading tail, and wherein said running web comprises a paper web.

6. The apparatus in accordance with claim 1, wherein said pivot axis is at least approximately vertical to a plane of a belt run direction.

7. An apparatus for transferring at least a portion of a running web, comprising:

a belt conveyor comprising:

at least two pulleys, in which at least one is a driven pulley;

an air-pervious endless conveyor belt tensioned over said at least two pulleys to form a loop;

a device for creating a negative pressure within said loop;

said at least one driven pulley being adapted to drive said endless conveyor belt over said at least two pulleys, wherein the negative pressure propagates through said at least one conveyor;

a connecting structure;

a rotatable support which rotates around a pivot axis;

said connecting structure coupling said belt conveyor to said rotatable support;

said rotatable support comprising a rotatable bearing housing fixed to said connecting structure, a stationary central stub, and at least one bearing; and said at least one bearing being arranged within said bearing housing, which is supported by one of said stationary central stub and a stationary central section of a vacuum channel.

8. The apparatus in accordance with claim 7, wherein at least one bearing comprises a pair of tapered antifriction bearings, and wherein said bearing housing is coupled to said stationary central stub by said pair of tapered antifriction bearings, and said rotatable bearing housing is fixed in both axial directions relative to the stub.

9. The apparatus in accordance with claim 8, further comprising at least one sealing device arranged between said housing and said stationary central stub, wherein an interior of said bearing housing is completely closed to an outside atmosphere.

10. The apparatus in accordance with claim 7, wherein said at least a portion of the running web comprises a threading tail, and wherein said running web comprises a paper web.

11. The apparatus in accordance with claim 7, wherein said pivot axis is at least approximately vertical to a plane of a belt run direction.

12. The apparatus in accordance with claim 7, wherein said pivot axis is about parallel to an axis of said first and second pulleys.

13. The apparatus in accordance with claim 7, wherein said rotatable support is connected to a stationary structure by a motor for pivoting said endless conveyor.

14. An apparatus for transferring at least a portion of a running web, comprising:

a belt conveyor comprising:

at least two pulleys, in which at least one is a driven pulley;

a suction box coupled to a vacuum source;

an air-pervious endless conveyor belt tensioned over said at least two pulleys, and said suction box being located within a loop of conveyor belt and positioned to create a vacuum sufficient to draw the at least a portion of the running web onto said endless conveyor belt;

said at least one driven pulley being adapted to drive said endless conveyor belt over said at least two pulleys and over said suction box;

a rotatable support which is rotatable around a pivot axis;

a connecting structure adapted to couple said belt conveyor with said rotatable support; and said connecting structure comprising a vacuum channel that couples said suction box to the vacuum source.

15. The apparatus in accordance with claim 14, wherein said vacuum box is positioned adjacent a return run of said endless conveyor belt to suction the return run.

16. The apparatus in accordance with claim 14, further comprising:

a stationary structure;

a stationary vacuum chamber;

said rotatable support comprising a rotatable bar having at least one end;

said at least one end of the rotatable bar being supported in a bearing coupled to said stationary structure;

said rotatable bar positioned to extend through said vacuum chamber, said vacuum chamber being fixedly coupled to said connecting structure and to said rotatable bar, whereby said vacuum chamber is rotatable;

said rotatable bar positioned to extend through said stationary vacuum chamber which is open to an interior of said rotatable vacuum chamber; and said stationary vacuum chamber being coupled to said vacuum source.

17. The apparatus in accordance with claim 16, wherein said pivot axis is at least approximately vertical to a plane of a belt run direction.

18. The apparatus in accordance with claim 14, wherein said pivot axis is about parallel to an axis of said first and second pulleys.

19. The apparatus in accordance with claim 14, wherein said rotatable support is connected to a stationary structure by a motor for pivoting said endless conveyor.

* * * * *